US006116803A

United States Patent [19]

Szekely et al.

[11] Patent Number: 6,116,803

[45] **Date of Patent: *Sep. 12, 2000**

[54] DISPENSER

[75] Inventors: Alex Szekely, Manalapan, N.J.; Joseph J. Prischak, Erie, Pa.

[73] Assignee: The Plastek Group, Erie, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/631,829

[22] Filed: Apr. 10, 1996

[51] Int. Cl.[7] ..... A45D 40/06; A45D 40/04

[52] U.S. Cl. ..... 401/266; 401/148; 401/175

[58] Field of Search ..... 401/148, 266, 401/175; 222/494, 212

[56] References Cited

U.S. PATENT DOCUMENTS

| | | | |
|---|---|---|---|
| 1,959,774 | 5/1934 | Walsh | 401/266 X |
| 2,196,379 | 4/1940 | Bender | 401/266 X |
| 2,921,324 | 1/1960 | Gibbons | 401/266 X |
| 2,961,679 | 11/1960 | Claypool | 401/266 |
| 4,480,940 | 11/1984 | Woodruff | 401/148 X |
| 4,506,809 | 3/1985 | Corsette | 222/494 X |
| 4,708,267 | 11/1987 | Sieverding et al. | 401/148 X |
| 4,913,322 | 4/1990 | Stoffler et al. | 222/494 X |
| 4,946,076 | 8/1990 | Hackmann et al. | 222/212 X |
| 5,275,496 | 1/1994 | Fattori et al. | 401/266 X |

FOREIGN PATENT DOCUMENTS

| | | | |
|---|---|---|---|
| 100204 | 2/1984 | European Pat. Off. | 401/148 |

*Primary Examiner*—Steven A. Bratlie
*Attorney, Agent, or Firm*—Bachman & Lapointe, P.C.

[57] ABSTRACT

A method and apparatus for applying extrudable product to an application surface while avoiding breakdown of the product into its constituent parts or avoiding undesirable product weeping.

6 Claims, 2 Drawing Sheets

DISPENSER

FIELD OF THE INVENTION

The present invention relates to dispensers and relates in particular to devices for dispensing material in the form of gels, semi-solids, cremes or pastes. Such materials have viscosities in the range of 50,000 to 200,000 centipoises.

BACKGROUND OF THE INVENTION

While the dispenser is useful to dispense deodorants, depilatories and various compounds for skin treatments it is to be understood that the invention is not limited to such materials.

The product is dispensed under pressure wherein, typically, a feed screw or finger power drives an elevator loaded with product, towards a perforated applicator surface so that the material is extruded through apertures in the applicator surface.

Since the material is pressurized by the advance of the loaded elevator there is a requirement to relieve pressure after application to avoid weeping at the applicator surface and, in some cases, to avoid break down of the product into its constituent parts.

While the prior art is replete with devices for providing pressure relief after application many such prior art units while useful are fairly complicated and expensive to produce. See for example U.S. Pat No. 5,000,356.

BRIEF SUMMARY OF THE INVENTION

It is an object of the present invention to provide a simple dispensing package operable to extrude product in the form of gels, semi-solids, cremes, pastes and the like.

It is also an object of the invention to provide a dispensing package having a floating head or dome including a perforated applicator surface which is operable to prevent weeping.

It is a further object of the invention to provide structure operable to relieve pressure built up during the course of extrusion of the product.

It is a further object of the invention to provide a novel method of relieving pressure.

It is a further object of the invention to provide structure which permits an applicator head or dome including an applicator surface to "float" through a definite stroke (usually along an axis of the overall unit) wherein the stroke has a definite limit.

It is a further object of the invention to provide an apertured applicator surface which is at least partially elastic operable to expand or bulge outwardly in response to internal pressure.

It is a further object of the invention to provide a rigid applicator surface.

It is a still further object of the invention wherein the resistance to flow through the apertures of the applicator surface is greater than the resistance to movement (float) of the applicator head.

A dispenser embracing one aspect of the invention may comprise a container means providing a receptacle for extrudable material to be dispensed, an applicator head having an applicator surface formed with at least one opening, means for connecting said applicator head to said container providing limited relative motion between the applicator head and the container means, and conveyor means within said container means for advancing the extrudable material toward said applicator head whereby said material is pressurized and said applicator head is first moved relative to said container means and thereafter said extrudable material is extruded through said at least one opening.

Another aspect of the invention is the provision of a method of relieving extrusion pressure to prevent weeping and to prevent compound break down comprising the steps of providing an applicator head having an apertured applicator surface which is movable from a first or rest position to a second operative position through a definite stroke or a definite distance in response to extrusion pressure, maintaining said extrusion pressure after said applicator head reaches said second position so that extrusion of said compound occurs through said apertured surface, and thereafter pressing said container against a surface to be treated with sufficient pressure to drive the applicator head from said second position to said first position while wiping said extruded compound upon the surface to be treated.

For a given product having a characteristic viscosity the total area of the apertures in the applicator head is dimensioned so that the resistance to product flow through the apertures is greater than the resistance to movement of the applicator head.

Thus, upon completion of the application of the product upon the treated surface, if residual internal pressure remains it is relieved automatically, without weeping or product break down, by movement of the applicator head from the first position toward said second position.

Therefore, the flow resistance relationship for materials having viscosities ranging from 50,000 to 200,000 centipoises can be indicated by the expression $R_A > R_H$ where R=resistance to flow, A=area of apertures in the applicator head and H=applicator head.

BRIEF DESCRIPTION OF THE DRAWINGS

Other features and advantages of the present invention will become more apparent from an examination of the succeeding specification when read in conjunction with the appended drawings, in which.

DETAILED DESCRIPTION OF THE INVENTION

Figure 1:
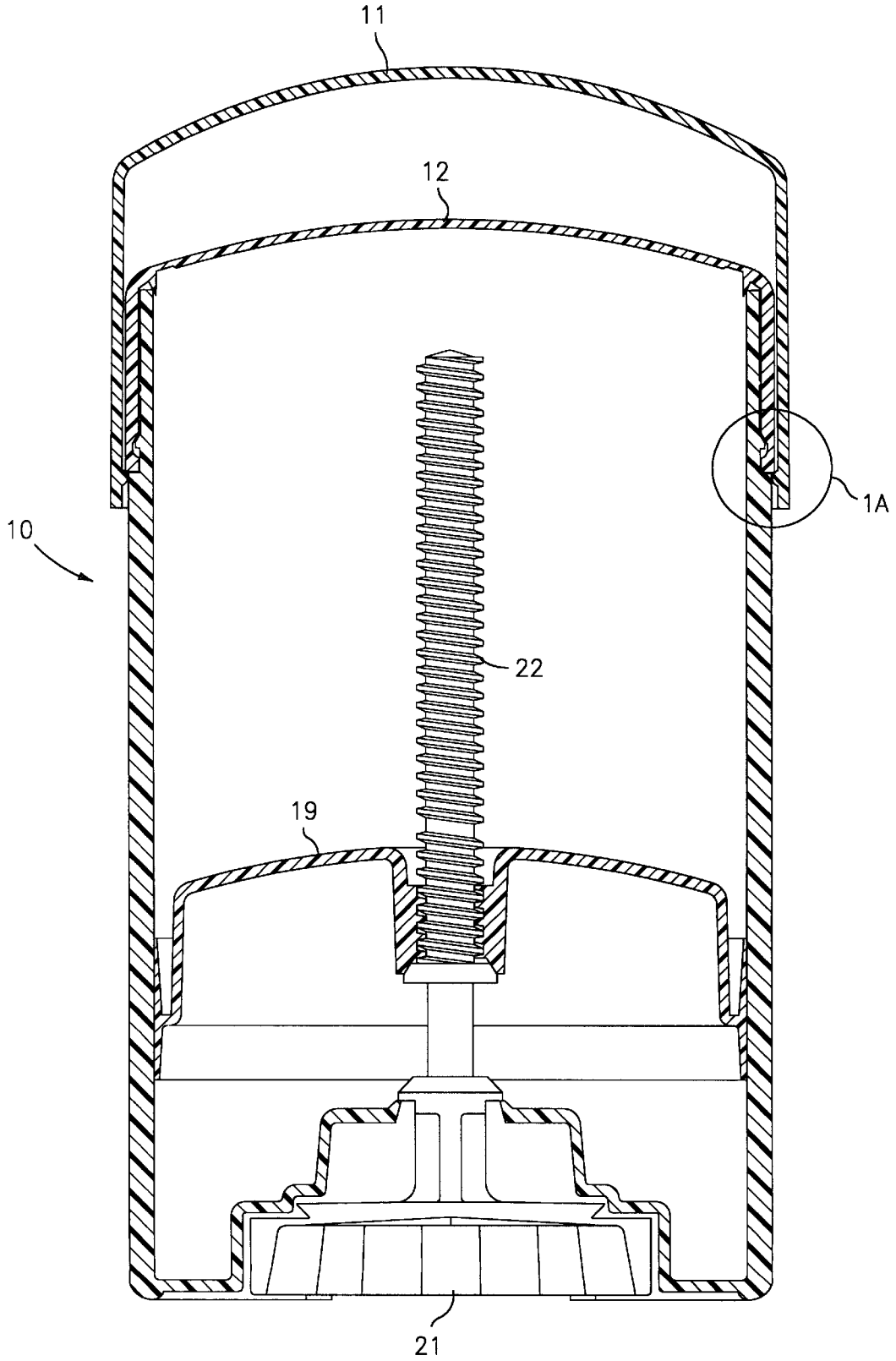
FIG. 1 is a vertical section of a dispenser showing the present invention employing a classic hand wheel and lead screw for operating a product elevator.

Referring to the several Figures the reference numeral 10 designates a container means having a closure 11 housing a floating applicator head 12 formed with a plurality of apertures 13.

Figure 1A:
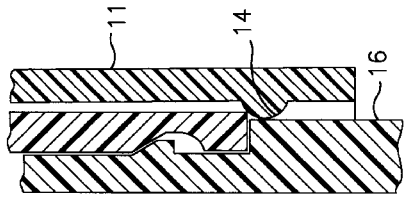
FIG. 1A is an enlargement of a portion of FIG. 1 showing the stroke between the first and second positions of the applicator head with the container closure in the closed position.
Figure 5:
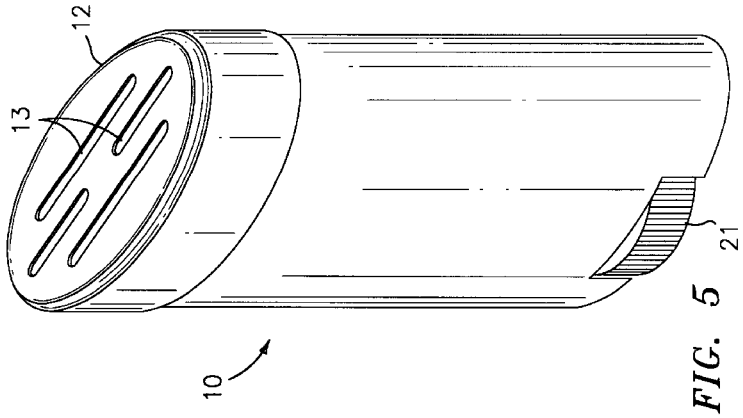
FIG. 5 is a perspective view of the dispenser showing the applicator surface of FIG. 2.

The closure 11, removable to expose the applicator head 12, is formed with an internal peripheral bead 14 making frictional contact with sidewall 16 of container means 10 as is most apparent in FIG. 1A.

In the disclosed embodiment of the invention the stroke of the applicator head is of the order of 1/32 inches. However, it is to be understood that the stroke can vary from nothing to 1/16 inches depending upon the viscosity of the material to be dispensed.

Figure 5A:
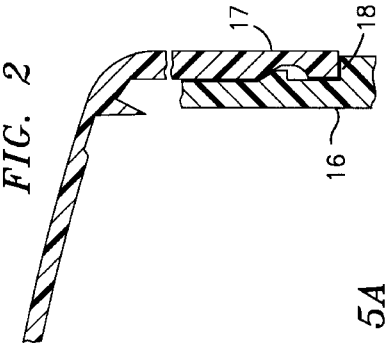
FIGS. 5A and 5B are detailed enlargements in section showing the first and second positions of the applicator head.

FIG. 5A shows the applicator head 12 in the first or rest position wherein the applicator head sidewall 17 is seated upon shoulder 18 formed in the container sidewall 16.

Figure 5B:
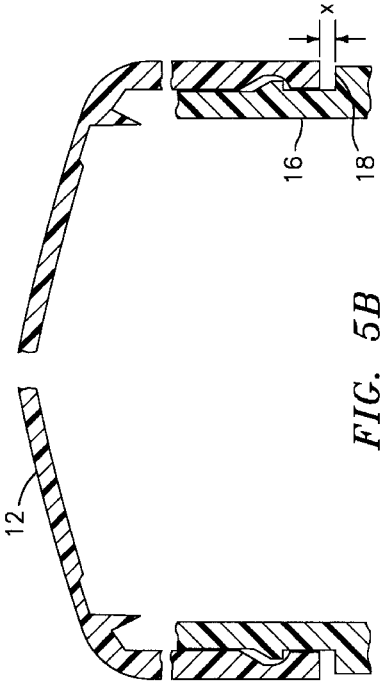

FIG. 5B shows the applicator head 12 advanced through a definite stroke X as a result of pressure created by product advanced by elevator 19 in response to rotation of hand wheel 21 and lead screw 22 in well known fashion.

Figure 2:
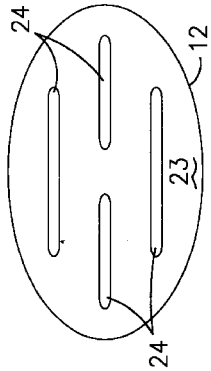
FIG. 2 shows a set of apertures in a relatively rigid applicator surface.

FIG. 2 shows a typical rigid applicator head 12 having an applicator surface 23 formed with a plurality of apertures 24. As stated earlier the total area of the apertures 24 has been calculated relative to the viscosity of the material being applied so that resistance to flow of the material through the apertures 24 is greater than the resistance to movement of the applicator head from the first position (FIG. 5A) to the second position (FIG. 5B).

Figure 3:
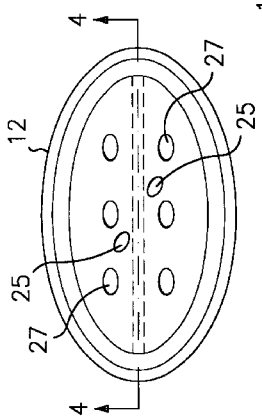
FIGS. 3 and 4 show a variation in the structure of the applicator head wherein a portion of the applicator surface is a perforated elastomer web with an underlying spring to keep the web distended.
Figure 4:
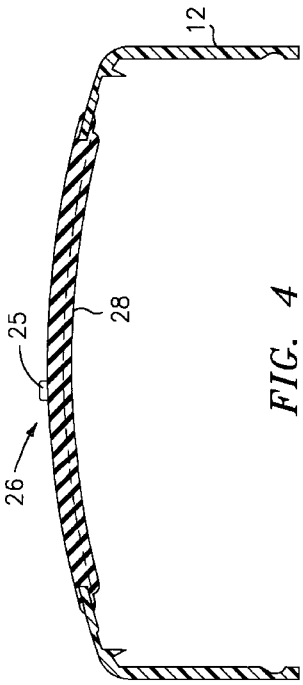

FIGS. 3 and 4 show an alternative applicator head 12 wherein a portion of the applicator surface includes a flexible plastic insert 26 having raised ribs 25 and apertures 27 maintained in a distended or bulged condition by a spring element 28. The raised ribs extend above the applicator surface a distance ranging from 1/32 to 3/32 inches.

The operation of the applicator head 12 occurs in the following fashion:

Assume that the elevator has been operated to pressurize product to be applied so that the head 12 moves (floats) from the first or rest position to the second position. Additional pressure advances or extrudes product through apertures 13, 24 or 27. The advance of the elevator is then stopped. Next the applicator head is wiped over the surface to be treated. Pressure during the course of wiping (application) pushes the head back to the position of FIG. 5A with attendant further extrusion. After completion of the wiping operation upon the surface to be treated and the dispenser unit is returned to storage with the applicator head wiped clean. Any residual pressure within the container is relieved by automatic movement of the applicator head towards the position of FIG. 5B thereby avoiding undesirable weeping of the product through apertures 13, 24 or 27 or breakdown of the product into its constituent parts.

The applicator head of FIGS. 3 and 4 operates in the same general fashion. The chief difference being that upon applying product to the surface to be treated application pressure dimples the flexible plastic insert 26 inwardly (against the spring 28) in addition to driving the head 12 back to the FIG. 5A or first position. The raised rib 25 aids in spreading and wiping the extruded material upon the surface to be treated.

Thus after the application step residual pressure is relieved by outward flexing of the plastic insert 26 as well as the movement of the head from the first position (FIG. 5A) toward the second position (FIG. 5B) as necessary.

It is anticipated that a variety of modification may be devised in addition to the disclosed embodiments without departing from the spirit and scope of the invention.

What is claimed is:

1. A dispenser for applying extrudable material to a surface to be treated comprising:

a container for receiving extrudable material having a viscosity, an applicator head having a wall defining an applicator surface and at least one opening on said applicator surface, said applicator head being connected movably to the container, said applicator head being slidable relative to said container from a first position through a restricted stroke (x) defining a maximum displaced position, and said container and said wall defining said applicator surface together defining a space for said extrudable material, means within the container for advancing said extrudable material under pressure toward said applicator head whereby said pressure moves said applicator head from said first position to said maximum displace position and said material is extruded through said at least one opening, the area of said at least one opening being calculated relative to the viscosity of the extrudable material so that resistance to flow of the extrudable material through said at least one opening is greater than resistance to flow required for movement of said applicator head from said first position to said maximum displaced position, whereby said extrudable material extrudes through said applicator head while said applicator head remains in said maximum displaced position, whereby, upon application of said extruded material to said surface to be treated, the applicator head is returned to its first position so that upon cessation of extrusion internal pressure is relieved by movement of the applicator head toward said maximum displaced position with no further extrusion.

2. The dispenser of claim 1 wherein the viscosity of the extrudable material ranges from 50,000 to 200,000 centipoises.

3. The dispenser of claim 1 wherein the applicator head includes a flexible plastic portion and said at least one opening is formed in said flexible plastic portion.

4. The dispenser of claim 3 wherein the flexible plastic portion includes at least one raised rib operable to engage said surface to be treated.

5. A dispenser for applying extrudable material to a surface to be treated comprising:

a container for receiving extrudable material having a viscosity, an applicator head having a wall defining an applicator surface and at least one opening on said applicator surface, said applicator head being connected movably to the container, said applicator head being movable relative to said container from a first position through a restricted stroke defining a maximum displaced position, wherein said container and said wall defining said applicator surface together define a space for said extrudable material, wherein the applicator head includes a flexible portion and said at least one opening is formed in said flexible portion and wherein the flexible portion includes at least one raised rib operable to engage said surface to be treated, means within the container for advancing said extrudable material under pressure toward said applicator head whereby said pressure moves said applicator head from said first position to said maximum displaced position and said material is extruded through said at least one opening, the area of said at least one opening being calculated relative to the viscosity of the extrudable material so that resistance to flow of the extrudable material through said at least one opening is greater than resistance to movement of said applicator head from said first position to said maximum displaced position, whereby said extrudable material extrudes through said applicator head while said applicator head remains in said maximum displaced position, whereby, upon application of said extruded material to said surface to be treated, the applicator head is returned to its first position so that upon cessation of extrusion internal pressure is relieved by movement of the applicator head toward said maximum displaced position with no further extrusion.

6. A dispenser for applying extrudable material for a surface to be treated, comprising:

a container for extrudable material;

an applicator head having a sidewall and a wall defining an applicator surface, wherein said container and said wall defining said applicator surface together define a space for said extrudable material, said sidewall being slidably mounted to the container for sliding movement relative to the container between a first position through a stroke (x) to a maximum displaced use position, said applicator surface having a flexible portion and at least one opening for flow of extrudable material, said opening being positioned on said flexible portion; and means for advancing extrudable material within the container toward the applicator head, whereby advancing extrudable material moves the applicator head from the first position to the maximum displaced use position, and whereby use forces the applicator head back towards the first position so as to provide at least a portion of said stroke (x) as a pressure release stroke for relieving pressure within said container.

* * * * *